US008936000B2

(12) United States Patent
Nonaka

(10) Patent No.: US 8,936,000 B2
(45) Date of Patent: Jan. 20, 2015

(54) HEAD COVER HAVING LUBRICATION STRUCTURE

(71) Applicant: Mahle Filter Systems Japan Corporation, Tokyo (JP)

(72) Inventor: Atsushi Nonaka, Kawagoe (JP)

(73) Assignee: Mahle Filter Systems Japan Corporation, Tokyo (JP)

( * ) Notice: Subject to any disclaimer, the term of this patent is extended or adjusted under 35 U.S.C. 154(b) by 0 days.

(21) Appl. No.: 14/088,790

(22) Filed: Nov. 25, 2013

(65) Prior Publication Data

US 2014/0174399 A1 Jun. 26, 2014

(30) Foreign Application Priority Data

Dec. 20, 2012 (JP) ..... 2012-277670

(51) Int. Cl.
*F01M 9/10* (2006.01)
*F01M 7/00* (2006.01)

(52) U.S. Cl.
CPC ..... *F01M 7/00* (2013.01)
USPC ..... 123/90.38; 123/195 C

(58) Field of Classification Search
USPC ..... 123/90.38, 195 C
See application file for complete search history.

(56) References Cited

FOREIGN PATENT DOCUMENTS

JP 5-47318 U 6/1993

*Primary Examiner* — Noah Kamen
(74) *Attorney, Agent, or Firm* — Foley & Lardner LLP

(57) ABSTRACT

A head cover having a lubrication structure, and having a box shape, the head cover includes: a side wall; a lower surface side which is opened, and which includes a lower surface circumference portion that is fixed to an upper portion of an engine; a lubrication opening which is opened in an upward direction, and which is disposed on an outer side of the head cover; and a lubrication passage extending from the side wall in an outward direction, and connecting the lubrication opening and an inside of the head cover.

4 Claims, 4 Drawing Sheets

PRIOR ART

HEAD COVER HAVING LUBRICATION STRUCTURE

BACKGROUND OF THE INVENTION

This invention relates to a head cover fixed to an upper portion of an engine, and more specifically to a lubrication structure arranged to supply an engine oil to an inside of the engine.

A Japanese Utility Model Application Publication No. 5-47318 discloses a head cover fixed to an upper portion of a cylinder head of an engine. This head cover includes a lubrication opening for supplying an engine oil. For example, as shown in FIG. 4, a lubrication opening 2 is formed on an upper wall portion of the head cover 1 so as to be opened in the upward direction. A filler cap 3 is detachably attached to this lubrication opening 2. The filler cap 3 seals the inside of the engine in a case other than the lubrication.

When an worker exchanges the oil, the filler cap 3 is detached, and the engine oil is supplied. When the engine is started in a state in which the worker does not close the filler cap 3 after the oil exchange operation, the engine oil scattered by cam shafts 5 and so on within a cylinder head 4 may be leaked from the lubrication opening 2 to the outside of the head cover 1. This is unusually dangerous.

Conventionally, there is known that a shielding plate 6 is provided below the lubrication opening 2 so as to block the oil scattered by the cam shaft 5 and so on. As shown in, for example, FIG. 4, this shielding plate 6 is integrally formed with the head cover 1 having the lubrication opening 2.

SUMMARY OF THE INVENTION

However, in the above-described structure in which the shielding plate is provided, the addition of the shielding plate causes the cost increase and the size increase. Moreover, it is not possible to basically predict the scattering direction of the oil scattering from the cam shaft and so on. Accordingly, the shape of the shielding plate is complicated, and the structure is complicated.

It is, therefore, an object of the present invention to provide a lubrication structure of a head cover devised to solve the above-described problems, and to attain the simplification of the head cover, and the size reduction of the head cover.

According to one aspect of the present invention, a head cover having a lubrication structure, and having a box shape, the head cover comprises: a side wall; a lower surface side which is opened, and which includes a lower surface circumference portion that is fixed to an upper portion of an engine; a lubrication opening which is opened in an upward direction, and which is disposed on an outer side of the head cover; and a lubrication passage extending from the side wall in an outward direction, and connecting the lubrication opening and an inside of the head cover.

DETAILED DESCRIPTION OF THE INVENTION

Figure 1:
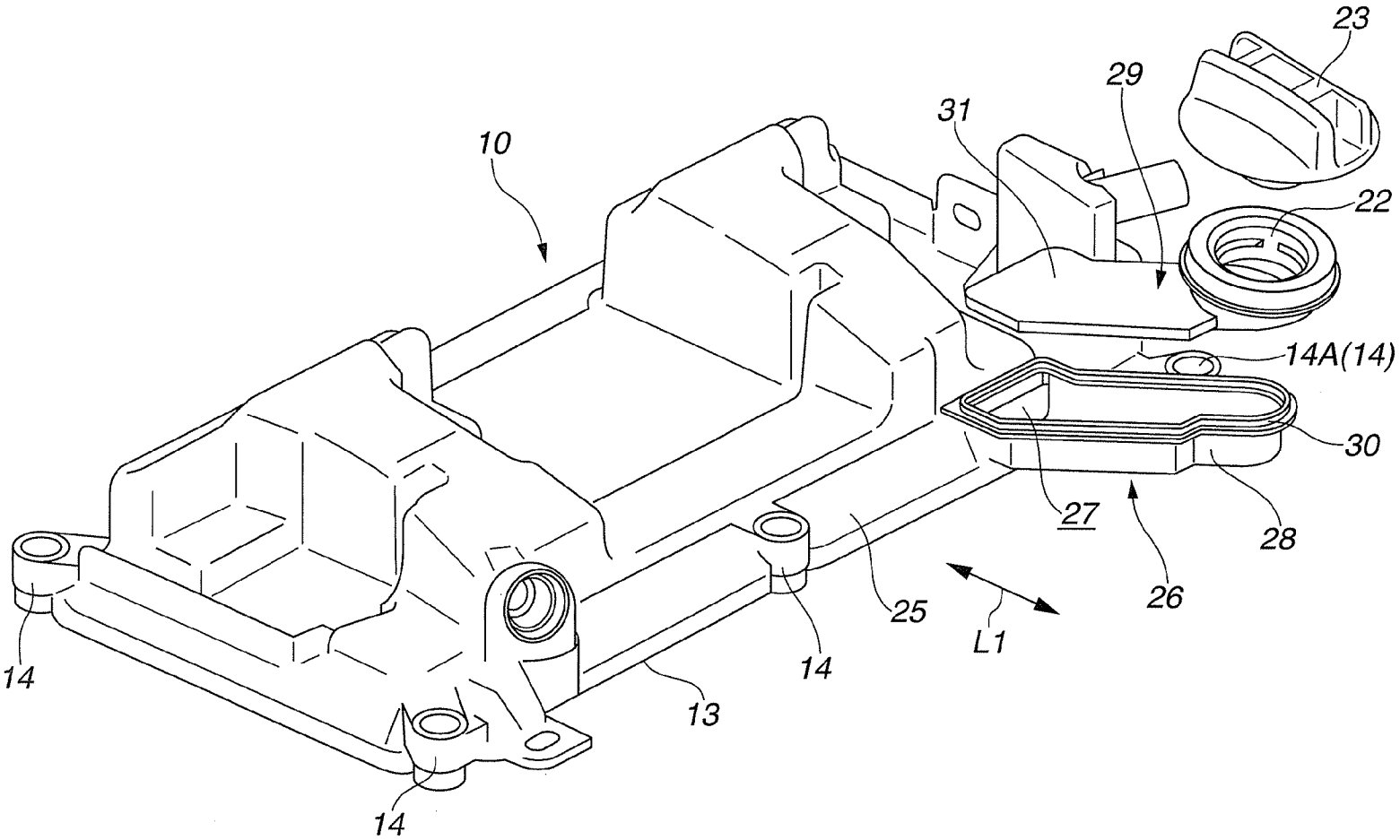
FIG. 1 is an exploded perspective view showing a head cover to which a lubrication structure according to one embodiment of the present invention is applied.
Figure 2:
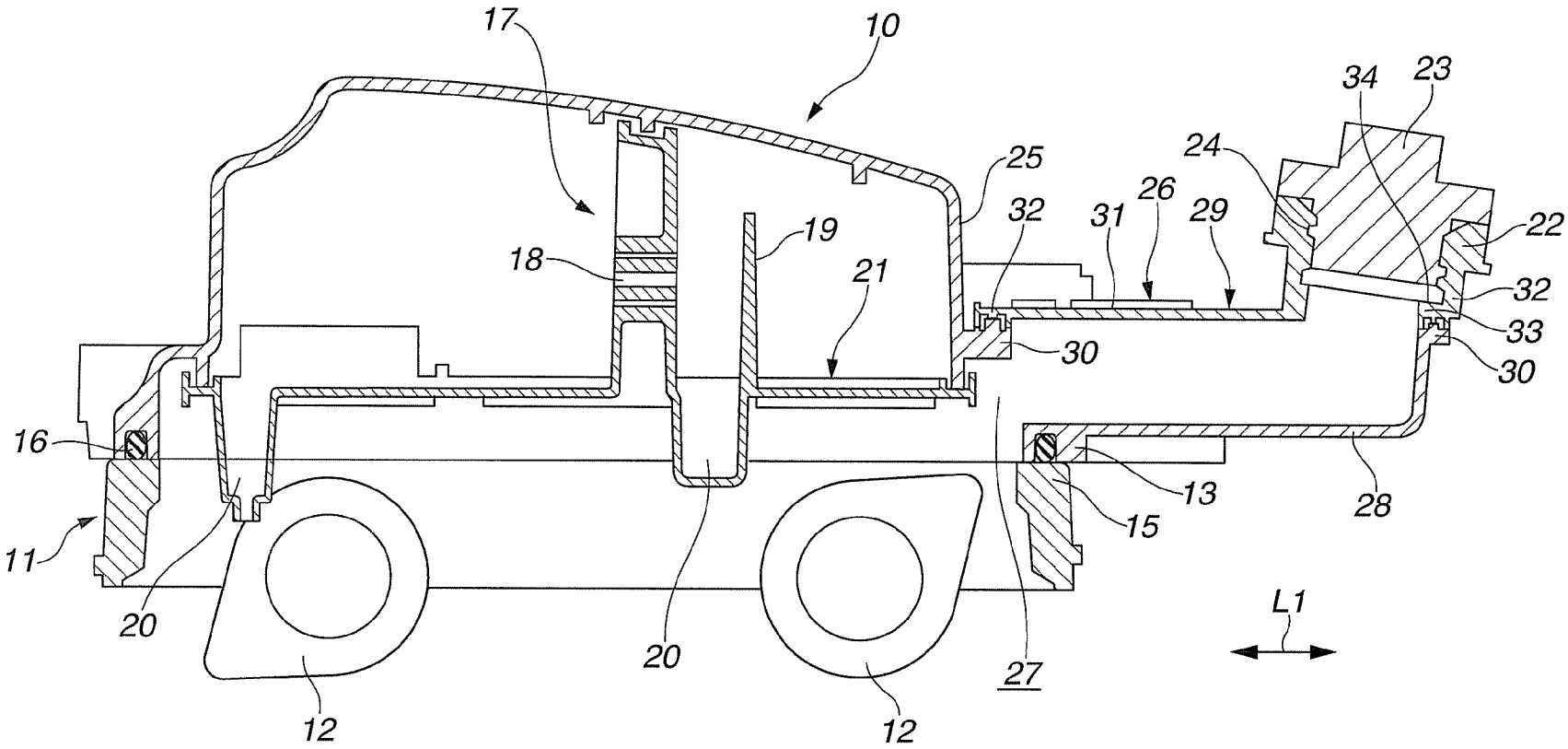
FIG. 2 is a sectional view showing the head cover of FIG. 1.
Figure 3:
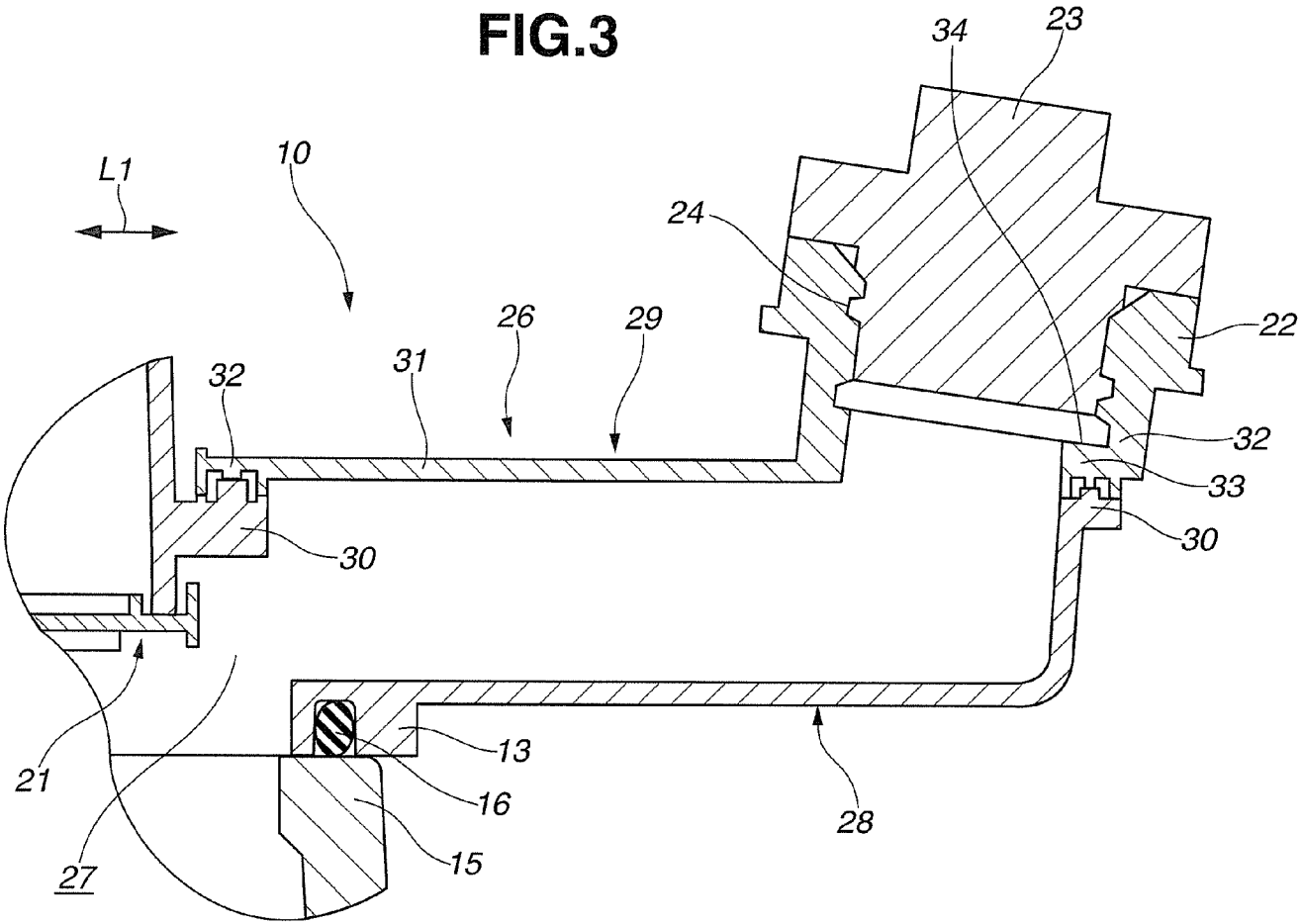
FIG. 3 is an enlarged sectional view showing a main part of the head cover of FIG. 2.
Figure 4:
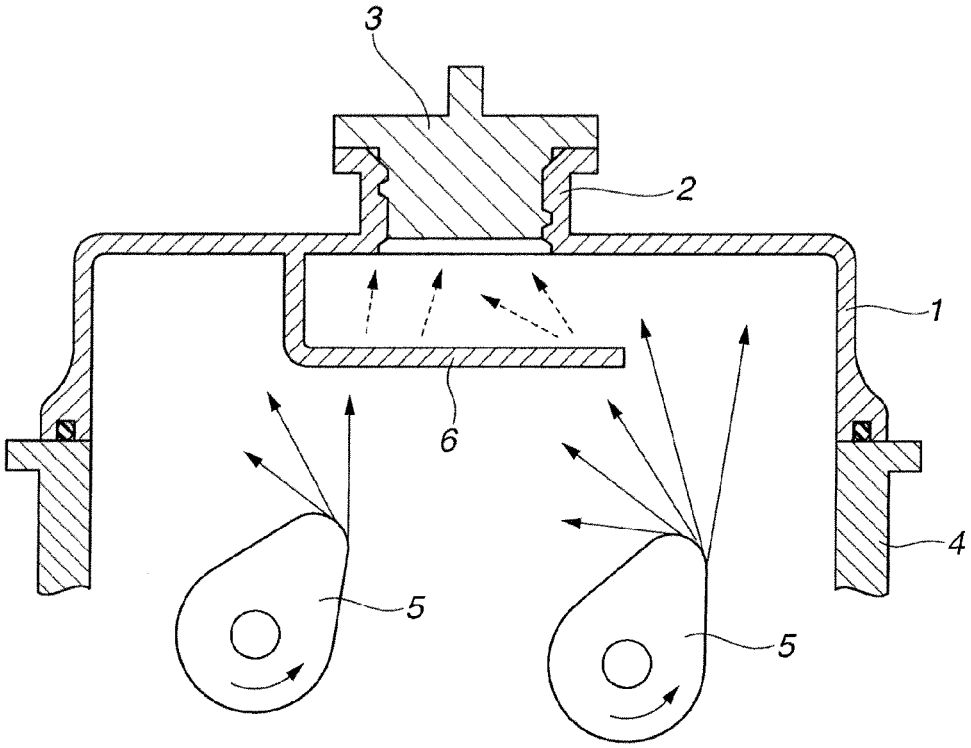
FIG. 4 is a sectional view showing a lubrication structure of a conventional head cover.

Hereinafter, the present invention is illustrated with reference to one embodiment shown by drawings. FIGS. 1-3 show a head cover 10 of an engine according to the one embodiment of the present invention. Two cam shafts 12 of an intake valve and an exhaust valve are rotatably disposed on a cylinder head 11 of the engine. The head cover 10 is mounted on an upper side of the cylinder head 11 to cover upper sides of the two cam shafts 12.

The head cover 10 is made from a lightweight and inexpensive synthetic resin material. The head cover 10 has a box shape having a lower surface side which is opened. This head cover 10 includes bolt boss portions 14 which are formed in a lower surface circumference portion 13 of the head cover 10 at appropriate intervals. The head cover 10 is fixed on an upper portion of the cylinder head 11 by bolts (not shown) inserted through these bolt boss portions 14. A seal ring 16 which is for ensuring a sealing property is disposed between the lower surface circumference portion 13 of this head cover 10 and an upper surface flange portion 15 of the cylinder head 11.

As shown in FIG. 2, an oil mist separator 17 is provided within the head cover 10. The oil mist separator 17 is arranged to separate an oil from blow-by gas. This oil mist separator 17 is well-known. Accordingly, this oil mist separator 17 is briefly illustrated below. In this oil mist separator 17, the blow-by gas flows through a narrow gas passages 18, and impinges on an impinging wall 19, so as to separate the oil. The separated oil is dropped from an oil dropping portion 20 to the inside of the cylinder head 11. These gas passages 18, the impinging wall 19, and the oil dropping portion 20 are provided in a bottom portion plate 21 which is joined and fixed to the lower surface side of the head cover 10.

Next, the lubrication (oil filling) structure of the head cover 10 which is a main part of this embodiment is illustrated. This head cover 10 includes an lubrication opening 22 which has a substantially cylindrical shape, and which is opened in the upward direction. A filler cap 23 is detachably attached to this lubrication opening 22. Screw portions 24 are formed on an inner circumference of the lubrication opening 22 and an outer circumference of the filler cap 23. These screw portions 24 of the lubrication opening 22 and the filler cap 23 are screwed with each other.

In this embodiment, this lubrication opening 22 is formed on an outer side of the lower surface circumference portion 13 of the head cover 10. That is, in FIG. 2, the entire of the lubrication opening 22 is disposed on the outer side of the lower surface circumference portion 13 of the head cover 10, so as not to be overlapped with the lower surface circumference portion 13 (the head cover 10) in upward and downward directions in FIG. 2. That is, when the head cover 10 is viewed from above, the lubrication opening 22 is deviated (misaligned) from the head cover 10.

The lubrication opening 22 and the inside of the head cover 10 are connected by a lubrication passage 26 which has a tubular shape extending from a side wall 25 of the head cover 10 to the outside. That is, one end of the lubrication passage 26 is connected to the inside of the head cover 10 through an opening portion 27 which is formed and opened in the side wall 25. The other end of the lubrication passage 26 has an L-shape bent in the upward direction. The other end of the lubrication passage 26 is connected to the cylindrical lubrication opening 22.

This lubrication passage 26 has a divided structure having an upper section and a lower section. The lower section 28 is integrally formed with the head cover 10. The lubrication opening 22 is integrally formed with the upper divided member 29 which is the upper section. That is, the lubrication passage 26 is constituted by two components of the head cover 10 and the upper divided member 29.

As shown in FIG. 1, the lower section 28 of the lubrication passage 26 has a tubular shape which has an upper opening. One end portion of the lower section 28 of the lubrication passage 26 is integrally connected with the side wall 25 of the head cover 10. The upper divided member 29 is joined so as to close the upper opening of the lower section 28. This upper divided member 29 includes a plate portion 31 which is joined to an upper surface opening circumference portion 30 of the lower section 28, so as to constitute a roof of the lubrication passage 26. The cylindrical lubrication opening 22 is integrally formed in one end portion of this plate portion 31. This upper divided member 29 is made from the lightweight and inexpensive synthetic resin material, like the head cover 10. The upper surface opening circumference portion 30 of the lower side portion 28 and a lower surface opening circumference portion 32 of the upper divided member 29 are joined by the vibration welding.

In this embodiment, the lubrication opening 22 which is opened in the upward direction is deviated from the lower surface circumference portion 13 of the head cover 10 in the outside direction. With this, the lubrication passage 26 connecting the side wall 25 of the head cover 10 and the lubrication opening 22 serves as a shielding plate. The scatter of the oil within the head cover 10 is not adhered to the lubrication opening 22. Accordingly, it is possible to surely prevent the leakage of the oil from the lubrication opening 22.

Moreover, another shielding plate need not to be provided since the lubrication passage 26 serves also as the shielding plate. Consequently, it is possible to simplify the structure of the head cover 10. Furthermore, since the shielding plate needs not to be provided below the lubrication opening 22, it is possible to reduce the size of the head cover 10, in particular, with respect to the upward and downward directions of the engine. Moreover, the lubrication opening 22 and the filler cap 23 need not to be provided on the upper surface of the head cover 10, and the lubrication passage 26 extends in the side (lateral) direction from the side wall 25 of the head cover 10. Accordingly, as shown in FIG. 2, the lubrication opening 22 and the filler cap 23 can be disposed at a position lower than the upper end of the head cover 10. Consequently, it is possible to decrease an overall height of the engine. Therefore, it is possible to ensure a wide space between the engine and the bonnet. This space serves as a shock-absorbing space. Accordingly, it is possible to improve the pedestrian protection at the collision of the vehicle.

Moreover, the lubrication passage 26 is divided to the upper and lower sections. Accordingly, it is possible to form the lubrication passage 26 by the two components of the head cover 10 and the upper divided member 29 which are made from the synthetic resin, without the undercut shape. Furthermore, the lower section 28 of the lubrication passage 26 is integrally formed with the head cover 10, and the upper divided member 29 which is the upper section with respect to the lower side portion 28 includes the lubrication opening 22. With this, it is possible to easily form the lubrication passage 26 and the lubrication opening 22 which are formed from these two components, and which has a simple structure.

As shown in FIG. 3, the upper divided member 29 includes a mounting seat portion 33 which has a predetermined thickness, which is provided on the lower surface opening circumference portion 32 near the lubrication opening 22, and which is joined with the lower section 28 of the lubrication passage 26. An upper surface of this mounting seat portion 33 serves as a seat surface 34 which is pressed by the jig when the upper surface opening circumference portion 30 of the lower section 28 and the lower surface opening circumference portion 32 of the upper divided member 29 are joined with each other by the vibration welding. This mounting seat portion 33 is provided in the inside of the lubrication passage 26. That is, the flange-shaped seat portion 33 is provided to protrude toward the inside of the lubrication passage 26. With this, there is no portion protruding in the outward direction. Accordingly, it is possible to reduce the size of the head cover, to employ this structure even in a case in which the layout space is small, and to improve the vehicle mountability, relative to a case in which the mounting seat portion 33 protrudes in the outward direction.

As shown in FIG. 1, the lubrication passage 26 is disposed near the bolt boss portion 14. That is, the lubrication passage 26 protrudes to be obliquely inclined with respect to a widthwise direction L1 of the head cover, to get close to the bolt boss portion 14A positioned at the corner portion. The lubrication passage 26 is integrally formed with this bolt boss portion 14A to be substantially integrally continuous with this bolt boss portion 14A. In this way, the lubrication passage 26 is disposed near the bolt boss portion 14A. That is, the lubrication passage 26 and the bolt boss portion 14A are integrally formed with each other. With this, it is possible to improve the rigidities of the lubrication passage 26 and the bolt boss portion 14A in cooperation with each other. Moreover, as shown in FIG. 1, the lubrication passage 26 is obliquely inclined with respect to the cover widthwise direction L1 so as to get close to the bolt boss portion 14A. With this, it is possible to suppress the protruding amount of the cover widthwise direction L1 of the lubrication passage 26 while ensuring the length of the lubrication passage 26 in a some measure for preventing the leakage of the oil, and thereby to reduce the size and to improve the vehicle mountability.

As described above, the present invention is illustrated with reference to the embodiment. However, the present invention is not limited to the above-described embodiment. Various variations may be included. For example, in the above-described embodiment, the head cover 10 and the upper side divided member 29 are fixed by the vibration welding. However, the head cover 10 and the upper side divided member 29 may be fixed by the screwing, or other welding.

In the embodiment of the present invention, a head cover having a lubrication structure, and having a box shape, the head cover includes: a side wall; a lower surface side which is opened, and which includes a lower surface circumference portion that is fixed to an upper portion of an engine; a lubrication opening which is opened in an upward direction, and which is disposed on an outer side the head cover; and a lubrication passage extending from the side wall in an outward direction, and connecting the lubrication opening and an inside of the head cover.

In this way, the lubrication opening which is opened in the upward direction is deviated from the head cover in the outside direction. With this, the lubrication passage connecting the side wall of the head cover and the lubrication opening serves as a shielding plate. The scatter of the oil within the head cover is not adhered to the lubrication opening. Accordingly, it is possible to prevent the leakage of the oil from the lubrication opening.

Moreover, another shielding plate need not to be provided since the lubrication passage serves as the shielding plate. Consequently, it is possible to simplify the structure of the head cover. Furthermore, since the shielding plate needs not to be provided below the lubrication opening 22, it is possible to reduce the size of the head cover, in particular, with respect to the upward and downward directions of the engine.

Moreover, the lubrication opening and the filler cap need not to be provided on the upper surface of the head cover. Accordingly, it is possible to decrease an overall height of the engine. Consequently, it is possible to ensure a wide space between the engine and the bonnet. This space serves as a shock-absorbing space. Accordingly, it is possible to improve the pedestrian protection a the collision of the vehicle.

Moreover, it is possible to simplify the structure of the head cover, to reduce the size of the head cover while preventing the leakage of the oil from the lubrication opening.

In the head cover according to the embodiment of the present invention, the lubrication passage is divided into an upper section and a lower section; the lower section of the lubrication passage is integrally formed with the head cover; and the lubrication opening is formed in an upper divided member which constitutes the upper section. By the thus-constructed divided structure of the lubrication passage having the upper section and the lower section, it is possible to easily mold the head cover and the upper divided member from the synthetic resin and so on without the undercut shape. Accordingly, it is possible to easily form the lubrication passage and the lubrication opening while suppressing the number of the components to two of the head cover and the lower section of the lubrication passage.

In the head cover according to the embodiment of the present invention, the upper divided member includes a mounting seat portion which has a predetermined thickness, which is provided near the lubrication passage, and which is joined with the lower section; and the mounting seat portion protrudes inside the lubrication passage. By the thus-constructed structure in which the mounting seat portion is provided inside the lubrication passage, there is no portion protruding in the outward direction. Accordingly, it is possible to reduce the shape and the size of the head cover, and to improve the vehicle mountability, relative to a case in which the mounting seat portion protrudes in the outward direction.

In the head cover according to the embodiment of the present invention, the head cover further includes a bolt boss portion which is formed in the lower surface circumference portion, into which a bolt for fixing the head cover on the upper portion of the engine is inserted; and the lubrication passage is formed near the bolt boss portion. By the thus-constructed structure, it is possible to improve the rigidities of the bolt boss portion and the lubrication passage.

The entire contents of Japanese Patent Application No. 2012-277670 filed Dec. 20, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A head cover having a lubrication structure, and having a box shape, the head cover comprising:

a side wall;

a lower surface side which is opened, and which includes a lower surface circumference portion that is fixed to an upper portion of an engine;

a lubrication opening which is opened in an upward direction, and which is disposed on an outer side of the head cover; and a lubrication passage extending from the side wall in an outward direction, and connecting the lubrication opening and an inside of the head cover.

2. The head cover as claimed in claim 1, wherein the lubrication passage is divided into an upper section and a lower section; the lower section of the lubrication passage is integrally formed with the head cover; and the lubrication opening is formed in an upper divided member which constitutes the upper section.

3. The head cover as claimed in claim 2, wherein the upper divided member includes a mounting seat portion which has a predetermined thickness, which is provided near the lubrication passage, and which is joined with the lower section; and the mounting seat portion protrudes inside the lubrication passage.

4. The head cover as claimed in claim 1, wherein the head cover further comprises a bolt boss portion which is formed in the lower surface circumference portion, into which a bolt for fixing the head cover on the upper portion of the engine is inserted; and the lubrication passage is formed near the bolt boss portion.

* * * * *